US006659444B2

(12) United States Patent
Kawarama

(10) Patent No.: US 6,659,444 B2
(45) Date of Patent: Dec. 9, 2003

(54) SHEET FEED APPARATUS, AND RECORDING APPARATUS HAVING SHEET FEED APPARATUS

(75) Inventor: Makoto Kawarama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/077,859

(22) Filed: Feb. 20, 2002

(65) Prior Publication Data

US 2002/0117797 A1 Aug. 29, 2002

(30) Foreign Application Priority Data

Feb. 23, 2001 (JP) ..... 2001-047658

(51) Int. Cl.[7] ..... B65H 3/44

(52) U.S. Cl. ..... 271/9.09; 271/9.02; 271/9.11; 271/9.07

(58) Field of Search ..... 271/9.09, 9.02, 271/9.11, 9.07

(56) References Cited

U.S. PATENT DOCUMENTS 4,579,328 A * 4/1986 Hagihara et al. ..... 271/9.08
4,871,160 A * 10/1989 Yoshino ..... 271/9.02
4,896,871 A * 1/1990 Idenawa ..... 271/9.09
5,145,160 A * 9/1992 Nagashima et al. ..... 271/9.09
5,478,162 A * 12/1995 Nakayama et al. ..... 400/605
5,725,319 A 3/1998 Saito et al. ..... 400/629
6,135,438 A * 10/2000 Newman et al. ..... 271/9.07

FOREIGN PATENT DOCUMENTS

JP 04089730 A * 3/1992 ..... B65H/3/44
JP 05116784 A * 5/1993 ..... B65H/3/44

* cited by examiner

*Primary Examiner*—Donald P. Walsh
*Assistant Examiner*—M Kohner
(74) *Attorney, Agent, or Firm*—Fitzpatrick, Cella, Harper & Scinto

(57) ABSTRACT

In a sheet feed apparatus, a guide member formed by a flexible member is disposed at an aperture for manual sheet feeding provided on an upper surface of a sheet storing means, and sheets are guided to the position below a sheet feed means by the guide member, while underpropping the sheets, whereby the manual sheet feeding can be performed with the simple structure at low costs. Further, a space for the manual sheet feeding and the number of parts can be saved to the minimum.

14 Claims, 6 Drawing Sheets

SHEET FEED APPARATUS, AND RECORDING APPARATUS HAVING SHEET FEED APPARATUS

BACKGROUND OF THE INVENTION

1. Field of the Invention

The present invention relates to a sheet feed apparatus and a recording apparatus having the sheet feed apparatus, and more particularly, to a sheet feed apparatus capable of performing manual sheet feeding and a recording apparatus having this sheet feed apparatus.

2. Related Background Art

Conventionally, a recording apparatus such as a printer, a copying machine, a facsimile apparatus or the like ordinarily has a sheet feed apparatus for feeding sheets stored in a sheet storing means by using a sheet feed means. The sheets fed by the sheet feed apparatus are transported to an image recording unit by a sheet transportation means, and images are to be recorded on the sheets in the image recording unit.

As such the sheet feed apparatus, there is provided a sheet feed apparatus capable of performing manual sheet feeding so as to record images not only on standard sheets stored in the sheet storing means but also on nonstandard sheets designated by a user.

However, in this conventional sheet feed apparatus capable of performing the manual sheet feeding and the recording apparatus having this sheet feed apparatus, a dedicated sheet feed roller for the manual sheet feeding has to be added, and a space for the manual sheet feeding has to be separately secured.

Thus, if the dedicated sheet feed roller is added and the space for the manual sheet feeding is secured, the structure becomes complex and the size of the apparatus becomes large as a whole, and costs increase because the number of parts increases.

SUMMARY OF THE INVENTION

An object of the present invention is to provide a sheet feed apparatus capable of performing manual sheet feeding with simple structure at low costs, and a recording apparatus having such the sheet feed apparatus.

Another object of the present invention is to provide a sheet feed apparatus which comprises a sheet storing means for storing sheets; a sheet feed means, disposed in a state capable of closing to and leaving from the sheets stored in the sheet storing means, for feeding the sheets; a manual sheet feed unit disposed above the sheet storing means; and a guide member, disposed in the manual sheet feed unit, for guiding the manually fed sheets to the sheet feed means while underpropping those sheets, wherein the guide member is formed by a flexible member.

Still another object of the present invention is to provide a recording apparatus which comprises a head mounting unit for mounting a recording head; a sheet storing means for storing sheets; a sheet feed means, disposed in a state capable of closing to and leaving from the sheets stored in the sheet storing means, for feeding the sheets; and a guide member, disposed above the sheet storing means, for guiding the manually fed sheets to the sheet feed means while underpropping those sheets, wherein the guide member is formed by a flexible member.

DETAILED DESCRIPTION OF THE PREFERRED EMBODIMENTS

Hereinafter, the embodiments of the present invention will be explained in detail with reference to the attached drawings.

Figure 1:
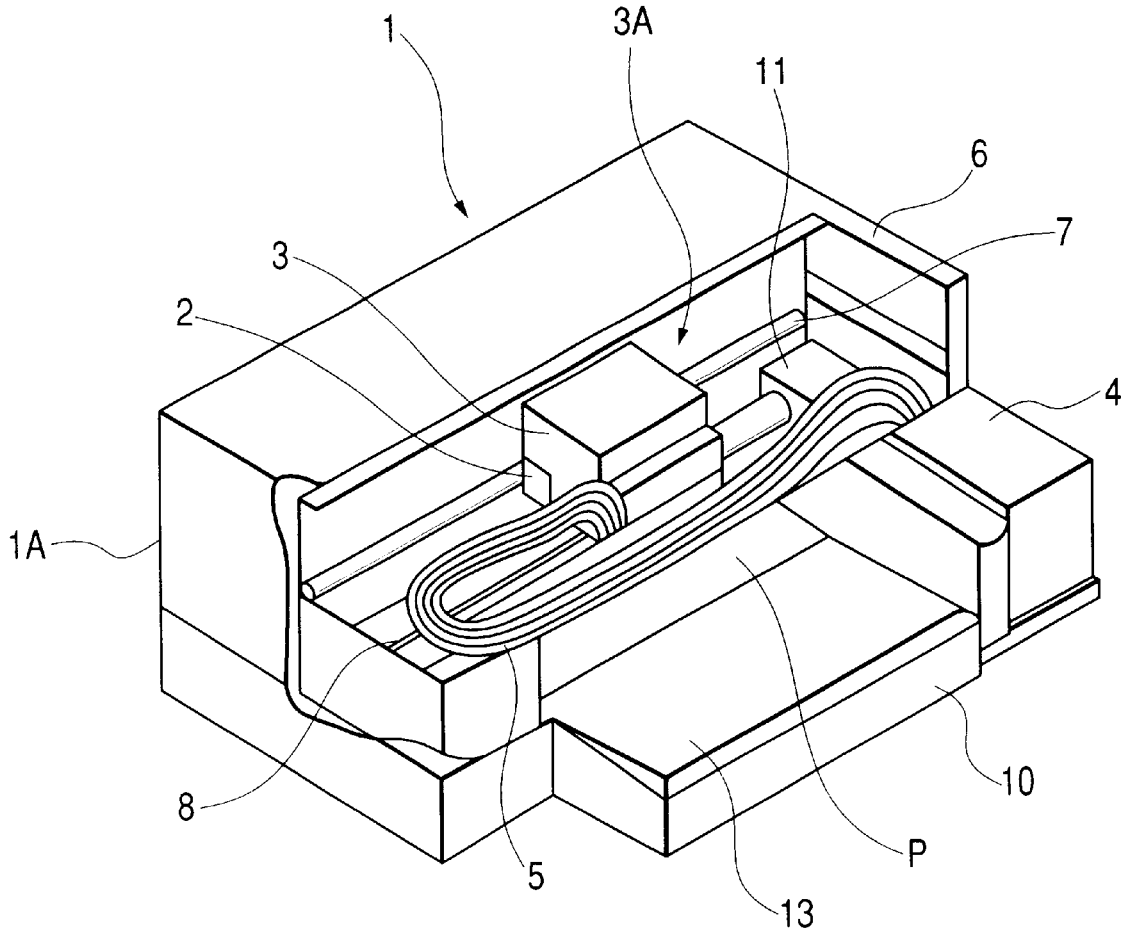
FIG. 1 is a perspective view showing an ink-jet printer being an example of a recording apparatus equipped with a sheet feed apparatus according to an embodiment of the present invention.

FIG. 1 is a perspective view showing an ink-jet printer being an example of a recording apparatus equipped with a sheet feed apparatus according to the embodiment of the present invention.

In FIG. 1, numeral 1 denotes the ink-jet printer, numeral 1A denotes a printer main body (hereinafter called a main body), and numeral 3A denotes an image recording unit. The image recording unit 3A has a recording head 3 and a carrier 2 used to mount the recording head 3.

The recording head 3 is structured to have plural nozzle arrays (not shown) in the sub scanning direction on the surface opposite to sheets P to discharge different color inks for each nozzle array. The ink is supplied to each color nozzle array in the recording head 3 from an ink tank 4 through a supply tube 5. The carrier 2 is slidably supported along a guide shaft 7 and a guide rail 8, of which the both ends are fixed to a frame 6 of the main body 1A, mutually disposed in parallel.

Images are recorded on the sheet by discharging the ink toward the sheet P from the recording head 3 while reciprocating the carrier 2. It should be noted that the carrier 2 is reciprocated by a belt driving apparatus and a motor (both not shown).

Figure 2:
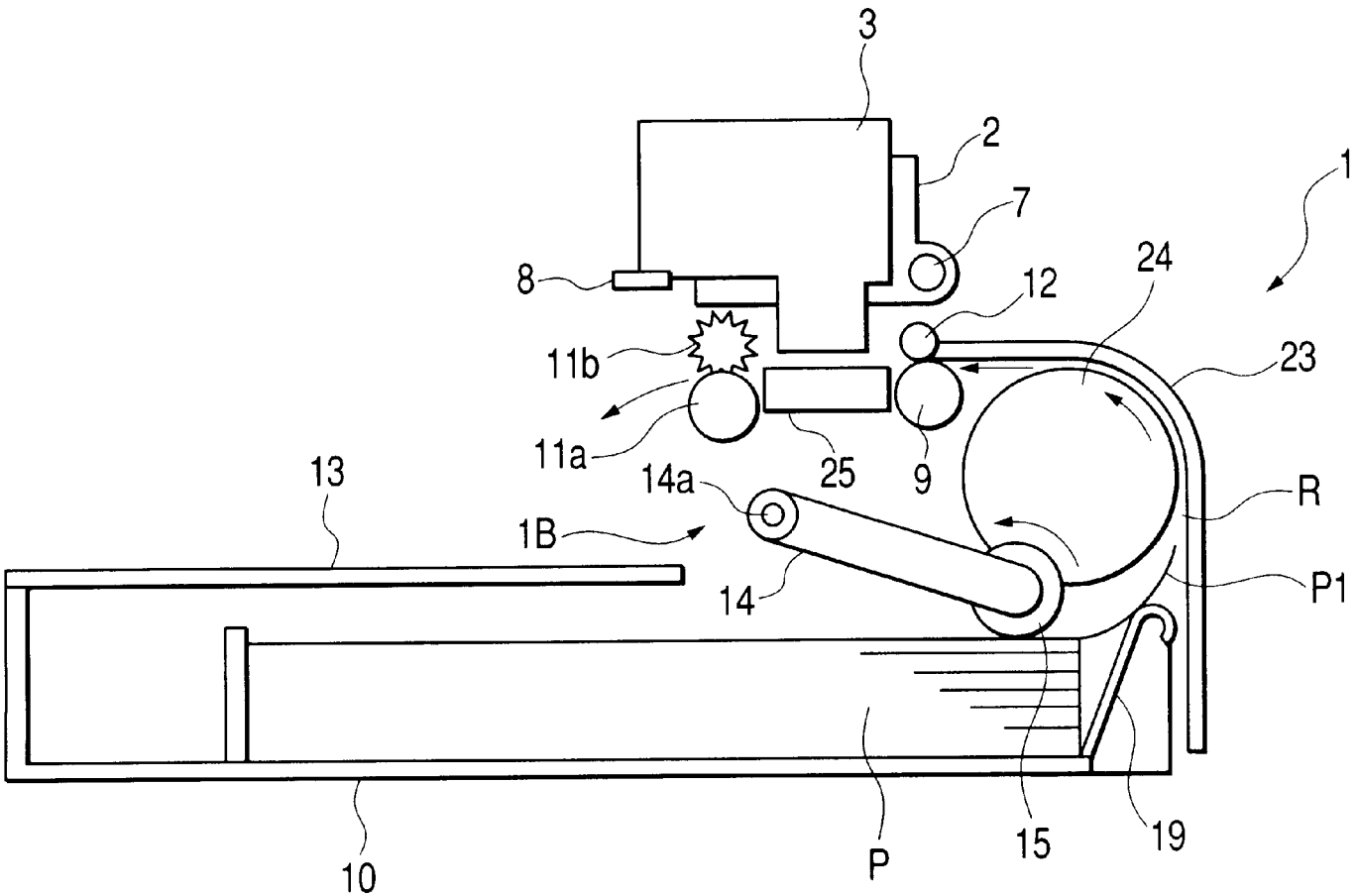
FIG. 2 is a sectional view showing the schematic structure of the ink-jet printer.

FIG. 2 is a sectional view showing the schematic structure of the ink-jet printer 1. In FIG. 2, numeral 1B denotes a sheet feed apparatus. The sheet feed apparatus 1B has a sheet feed cassette 10 being a sheet storing means detachably installed in the main body 1A, and a sheet feed roller 15 being a sheet feed means to feed the sheets P stored in the sheet feed cassette 10.

The sheet feed cassette 10 has a separation board 19 being an inclined plane member which is in contact with the sheets P fed by the rotation of the sheet feed roller 15 at the end of the downstream side of the sheet feed direction, so as to separate the sheet P.

The sheet feed roller 15 is provided above the sheet feed cassette 10. The roller 15 is stored rotatively by an arm 14, being a supporting member, also rotatively supported by a fulcrum 14*a* on the upstream side of the sheet feed roller 15, and in a state capable of closing to and leaving from the sheets P stored on the sheet feed cassette 10.

When the images are recorded, the sheet feed roller 15 comes into contact with an uppermost sheet P1 of the sheets P stored on the sheet feed cassette 10 owing to the weight of the roller 15 itself and the downward rotative motion of the arm 14. Then, the sheet feed roller 15 is rotated by the driving force from a not-shown driving source transmitted through a pulley 16, a belt 17 and a gear 18 shown in FIG. 3.

In FIG. 2, numeral 9 denotes a transportation roller, numeral 24 denotes a U-turn roller, and numeral 23 denotes a roller guide provided at the position opposite to the U-turn roller 24. The sheet P1 fed by the rotation of the sheet feed roller 15 is transported to the transportation roller 9 through a sheet transportation path R formed between the U-turn roller 24 and the roller guide 23.

Next, an image recording operation of the ink-jet printer 1 structured as above will be explained.

At first, the sheet feed roller 15 comes into contact with the uppermost sheet P1 of the sheets P stored on the sheet feed cassette 10 owing to the weight of the roller 15 itself and the downward rotative motion of the arm 14. In this state, the sheets P are fed if the sheet feed roller 15 rotates. Then, only the uppermost sheet P1 is separated by the separation board 19 (due to inclined plane separation), and the separated sheet P1 is then transported to the roller guide 23 while being in contact with the separation board 19.

The uppermost sheet P1 enters the sheet transportation path R and is then guided to a nipped portion between the transportation roller 9 and a pinch roller 12 by the rotation of the U-turn roller 24. The sheet P1 is further transported to a platen 25 provided on the recording position opposite to the recording head 3 in a state that the sheet P1 is being nipped between the transportation roller 9 and the pinch roller 12.

Next, for the sheet P1 transported to the platen 25 as above, the recording operation by the recording head 3 mounted on the carrier 2 is started. If the recording operation for one scan by the recording head 3 ends, the recording operation is once interrupted, and the sheet P1 on the platen 25 is transported for a predetermined amount by the transportation roller 9. Then, a recording operation for next one scan is performed while moving again the carrier 2 along the guide shaft 7. After sequentially performing the recording operations by the recording head 3 on the platen 25 as above, the sheet is discharged on a cassette cover 13 by a sheet discharge roller 11*a* and a sheet discharge spur 11*b*.

In FIG. 1, numeral 11 denotes a head recovery means. The head recovery means 11 is provided at the position which becomes opposite to the recording head 3 when the carrier 2 moves to a home position provided in the vicinity of one end of the moving range of the carrier 2. The head recovery means 11 is operated in a recording standby state, before/after the recording operation, or in an interval between successive one-line recording operations, so as to perform various operations such as capping, absorption, wiping and the like to the recording head 3, whereby clogginess or the like of the recording head 3 is prevented, and thus the performance of the recording head 3 is maintained.

Figure 3:
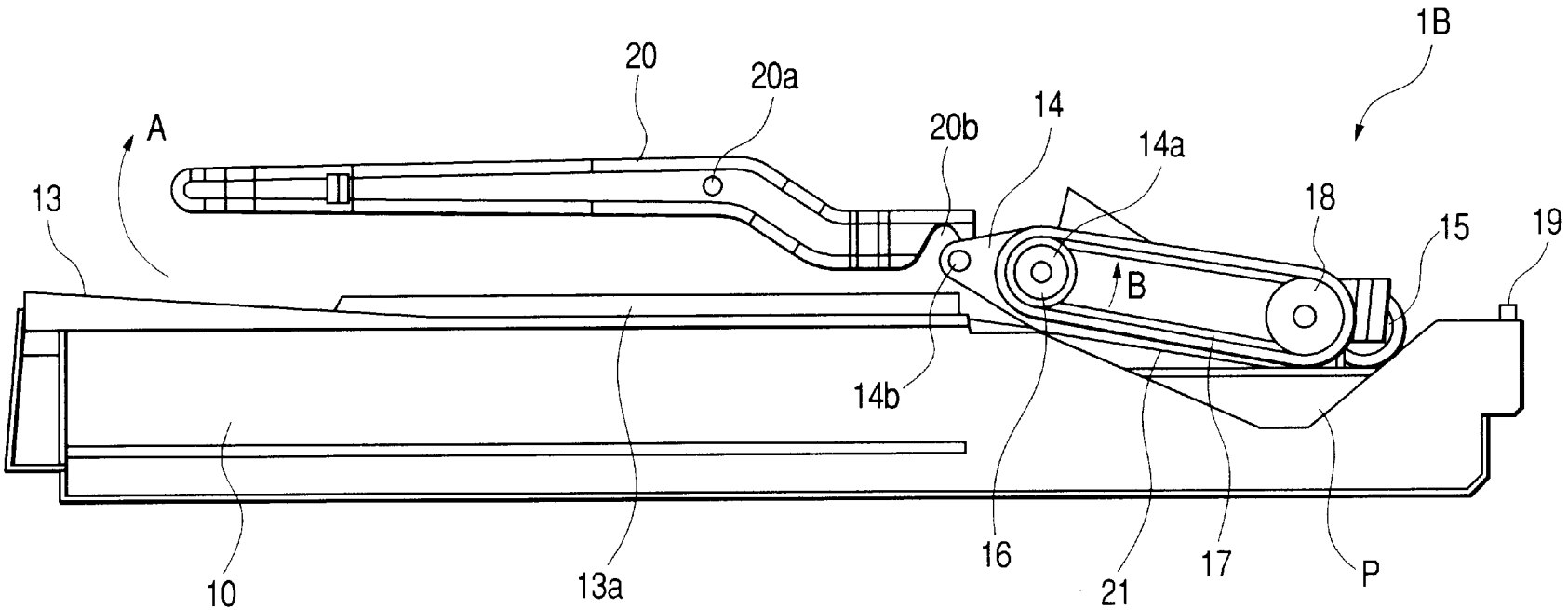
FIG. 3 is a sectional view showing the structure of the sheet feed apparatus.

Incidentally, in the present embodiment, a manual lever 20 being a lever member is provided as shown in FIG. 3 so that manual sheet feeding can be performed. In case of performing the manual sheet feeding, the manual lever 20 has to be pulled toward the direction indicated by an arrow A. When the manual lever 20 is pulled, the manual lever 20 rotatively moves clockwise around a manual lever shaft 20*a* treated as a fulcrum. When the manual lever 20 rotatively moves, an action part 20*b* provided at the inner end of the manual lever 20 rotatively moves downward to depress a release boss 14*b* being an engagement part of the arm 14.

The release boss 14*b* is provided at the manual lever side (upstream side of the sheet feed direction) across the arm shaft 14*a*. Consequently, as shown in FIG. 4, the sheet feed arm 14 rotatively moves counterclockwise around the arm shaft 14*a* as indicated by an arrow B, whereby the sheet feed roller 15 comes to a state of leaving from the sheets P set in the cassette 10.

Figure 4:
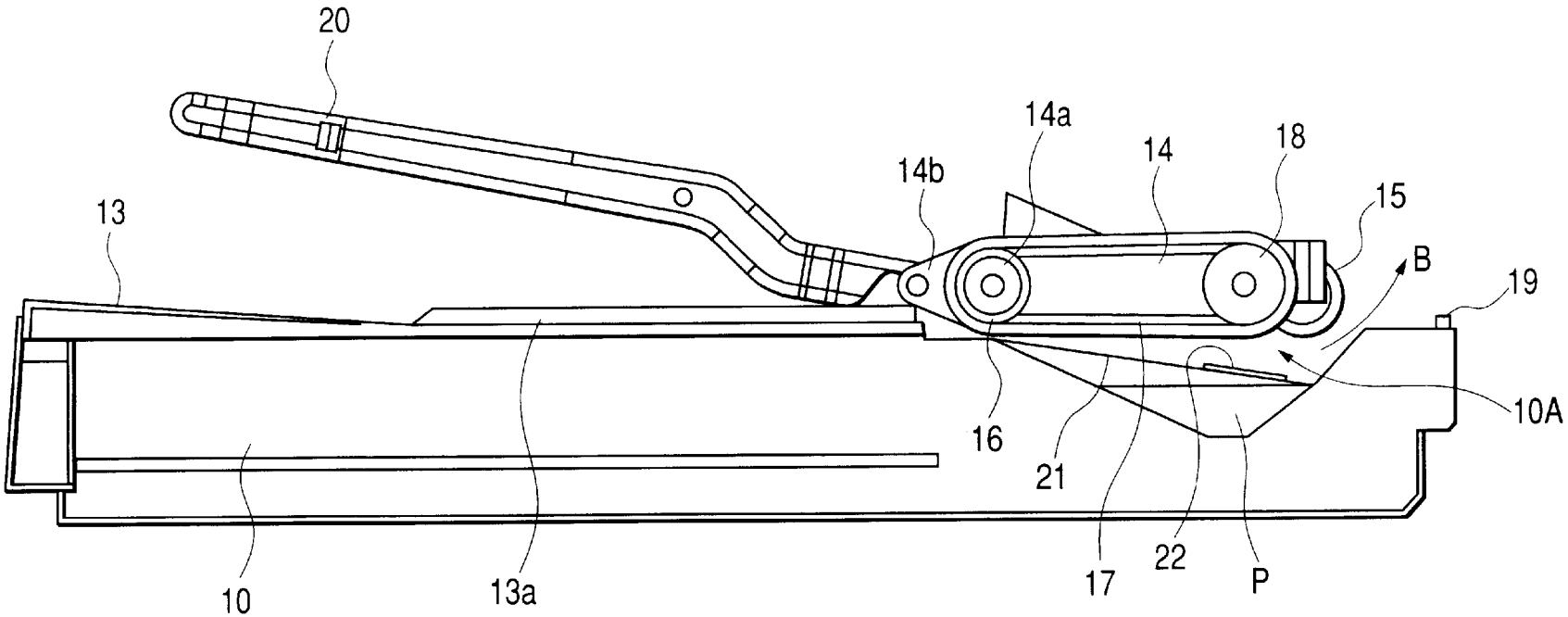
FIG. 4 is a side-view showing the locking state of the sheet feed apparatus.

On the other hand, as shown in FIG. 4, the cassette cover 13 being a cover member disposed on an upper surface of the sheet feed cassette 10 covers a part of the upstream side of the sheet feed direction of the sheet feed cassette 10. An aperture 10A for the manual sheet feeding is disposed at the downstream side of the sheet feed direction of the sheet feed cassette 10 not covered by the cassette cover 13.

Next, a manual sheet feeding operation of the ink-jet printer 1 as structured above will be explained.

Figure 5:
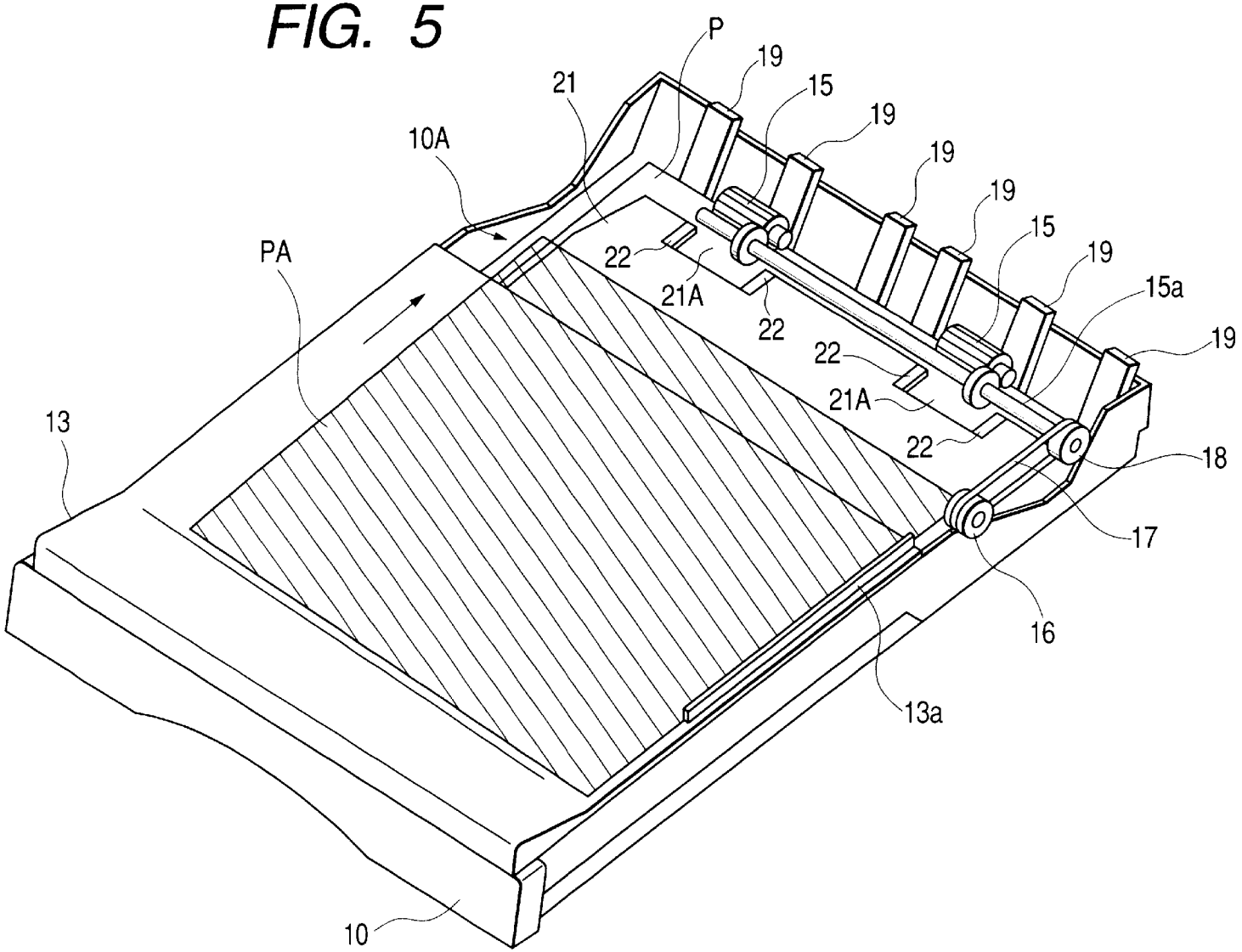
FIG. 5 is a perspective view showing the structure of a sheet feed cassette of the sheet feed apparatus.

In case of performing the manual sheet feeding operation, at first, the sheet feed roller 15 has to be in a state of leaving from the sheets by using the manual lever 20 as shown in FIG. 4. Next, as shown in FIG. 5, a manual feed sheet PA is fed from the aperture 10A for the manual sheet feeding along a sheet base rib 13*a* provided in the cassette cover 13 with a state that the sheet PA reaches the separation board 19 of the sheet feed cassette 10.

Figure 6:
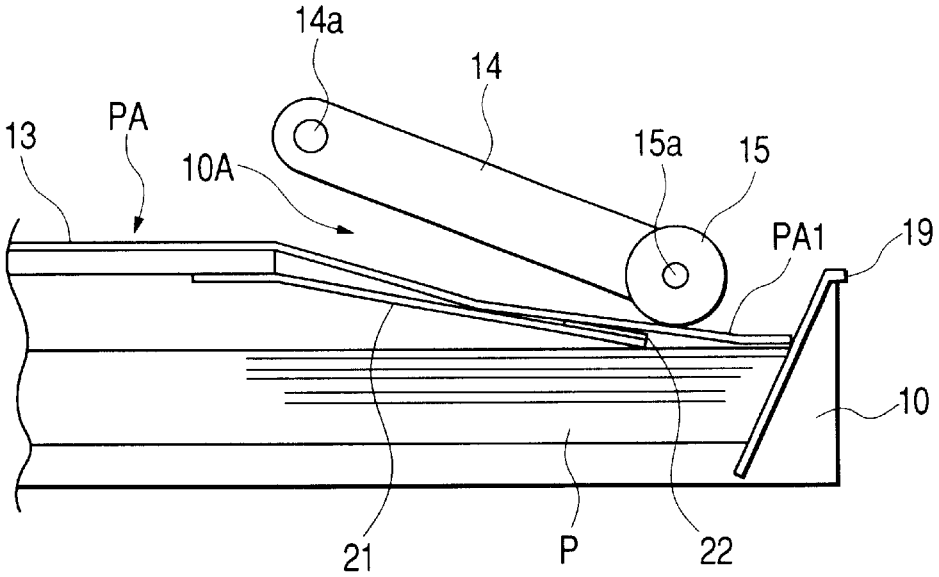
FIG. 6 is a side-view showing a state in case of manual sheet feeding in the sheet feed apparatus.

Subsequently, in this state, the manual lever 20 is rotatively moved backward against the direction indicated by the arrow A to release the locking state of the arm 14, whereby, as shown in FIG. 6, the sheet feed roller 15 comes into contact with the uppermost sheet PA1 of the manually fed sheets PA. Thereafter, the sheet PA1 is transported to the image recording unit 3A by the rotation of the sheet feed roller 15 which is in a state of being in contact with the sheet PA1.

Incidentally, in FIGS. 5 and 6, numeral 21 denotes a manual guide unit being a guide member which is provided at the downstream side of the sheet feed direction of the cassette cover 13 and used to guide the sheets PA to be manually fed to the position below the sheet feed rollers 15 while underpropping the sheets PA. This manual guide unit 21 is disposed at a position opposite to the sheet feed rollers 15 when the sheet feed cassette 10 is installed in the main body 1A. It should be noted that this manual guide unit 21 has flexibility so that the manual feed sheets PA can be surely guided to the position below the sheet feed rollers 15.

In this manner, the manual guide unit 21 having the flexibility is disposed at the aperture 10A for the manual sheet feeding provided on the upper surface of the sheet feed cassette 10, and the manual feed sheets PA are guided to the position below the sheet feed rollers 15 by the manual guide unit 21, whereby the manual sheet feeding can be performed with the simple structure at low costs. Further, a space for the manual sheet feeding and the number of parts can be minimized.

On the other hand, as shown in FIG. 5, apertures 21A for the contact of the manual guide unit 21 are provided at the positions opposite to the sheet feed rollers 15. By providing the apertures 21A for the contact, even when the manual sheet feeding is not performed, the sheet feed rollers 15 can come into contact with the uppermost sheet P1 stored on the sheet feed cassette 10, and the sheets stored in the sheet feed cassette 10 can be sent out.

Incidentally, the manual guide unit 21 sometimes does not bend downward due to its rigidity (toughness), or if the manual guide unit 21 bends, the bent magnitude is sometimes resulted in insufficient. In this case, if the sheet feed rollers 15 rotatively move downward upon decreasing the sheets stored in the sheet feed cassette 10, a shaft 15*a* of the sheet feed rollers 15 comes into contact with a part between the apertures of the manual guide unit 21. When the shaft 15*a* of the sheet feed rollers 15 comes into contact with the manual guide unit 21, the sheet feed rollers 15 are not completely fallen due to the rigidity (toughness) of the manual guide unit 21, and the sheet feed rollers 15 sometimes can not come into contact with the sheets P stored on the sheet feed cassette 10.

Therefore, in the present embodiment, the manual guide unit 21 is structured by the member having the flexibility so that the manual guide unit 21 can bend downward when the shaft 15*a* of the sheet feed rollers 15 comes into contact with the manual guide unit 21. That is, the manual guide unit 21 is structured by the member having such the rigidity capable of being bent together with the sheet feed rollers 15 when the manual guide unit 21 is in contact with the shaft 15*a* of the sheet feed rollers 15. According to this structure, even if the number of the sheets stored in the sheet feed cassette 10 decreases, the sheet feed rollers 15 can rotatively move downward, and the sheets P are surely sent out.

On the other hand, in case of sending out the sheets PA manually fed by the sheet feed rollers 15, the sheets P stored on the sheet feed cassette 10 have not to be transported together with the sheets PA. Accordingly, it is required to structure that the sheets PA do not come into contact with the sheets P stored on the sheet feed cassette 10 even if the sheet feed rollers 15 dig into the sheets PA manually fed when the sheets are fed.

Figure 7:
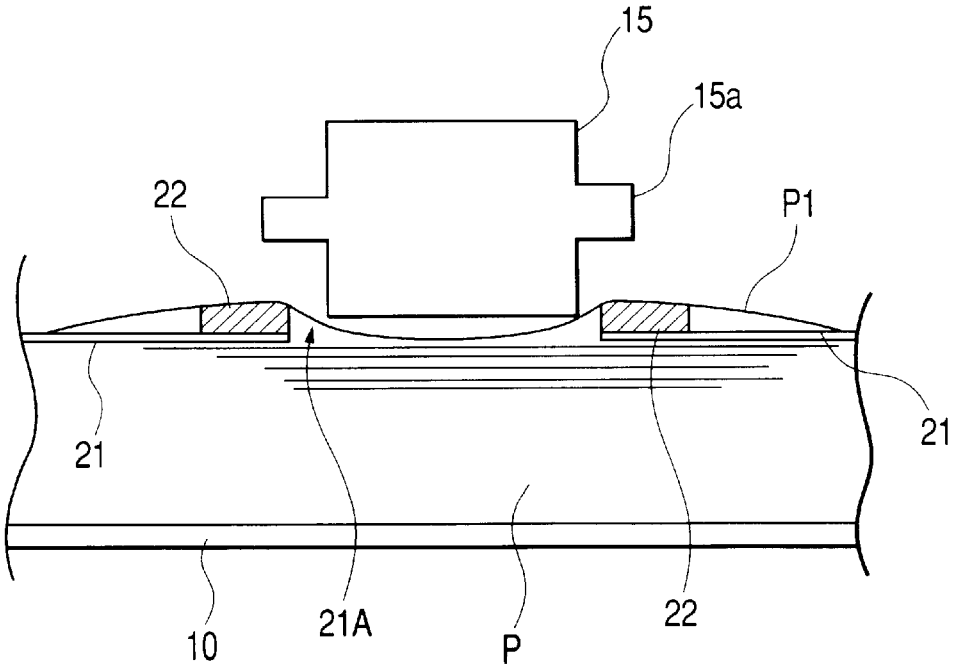
FIG. 7 is a view for explaining the structure of a manual guide unit provided in the sheet feed apparatus.

Therefore, in the present embodiment, thickness (height size) around the apertures of the manual guide unit 21 is structured thicker than that of the manual feed sheets PA as shown in FIG. 7. For example, if the thickness of the manual feed sheets PA is about 0.2 mm, the thickness around the apertures may be set to 0.8 mm to 1.0 mm. According to this structure, the manual feed sheets PA and the sheets P stored on the sheet feed cassette 10 are not transported in a state of overlapping each other.

Furthermore, when the few manual feed sheets PA are remained, for example, the last two sheets are remained, in order to surely separate the second to the last sheet from the last sheet, a separation sheet 22 being a friction member consisted of the material having a large friction coefficient such as the leather article or the like is pasted around the aperture. As a result, it is structured that the thickness around the aperture when the separation sheet 22 is pasted becomes such the thickness of 0.8 mm to 1.0 mm. According to this structure, even if plural sheets are manually fed, the sheet transportation can be surely performed until the last manual feed sheet without occurring the sheet overlapped transportation.

The above embodiment is structured in that the present invention is applied to a serial type recording apparatus of moving the recording head in the main scanning direction. However, the present invention is also applicable to a full-line type recording apparatus which records images by a recording head while sequentially transporting recording sheets using the recording head extensively exists for the whole area of the recording sheet width direction.

Further, in the above embodiment, an example of using a recording head of the so-called BJ (bubble-jet) system in the ink-jet system was explained. However, the present invention is not limited to the recording system of this kind of the recording head, but may be applied to various recording systems. The recording system of the recording head can be, for example, a piezoelectric system other than the BJ system, and a recording head based on a system having various recording elements such as a thermal transfer system or the like can be used besides the ink-jet system.

As explained above, according to the present invention, the guide member formed by the flexible member is disposed at the aperture for the manual sheet feeding provided on the upper surface of a sheet storing means, and the sheets are to be guided to the position below a sheet feed means by the guide member, while underpropping the sheets, whereby the manual sheet feeding can be performed with the simple structure at low costs.

What is claimed is:

1. A sheet feed apparatus comprising:

a sheet feed cassette for storing a sheet;

a sheet feed roller for feeding the sheet;

a manual sheet feed unit disposed above said sheet feed cassette;

a cover member for covering an upper surface of said sheet feed cassette; and a guide member, disposed in said manual sheet feed unit for guiding the manually fed sheet to said sheet feed roller while underpropping the sheet, wherein said guide member is positionally fixed to said cover member, said guide member having an aperture which allows said sheet feed roller to come into contact with the sheet stored in said sheet feed cassette.

2. An apparatus according to claim 1, wherein said guide member is formed by a flexible member.

3. An apparatus according to claim 1, wherein a friction member is disposed around said aperture.

4. An apparatus according to claim 1, wherein said aperture has a height of a size so as to prevent the sheet guided by said guide member and manually fed from coming into contact into contact with the sheet stored in said sheet storing means.

5. An apparatus according to claim 1, wherein said guide member has the rigidity capable of being bent when a shaft of said sheet feed roller comes into contact with said guide member.

6. An apparatus according to claim 1, further comprising a lever member for separating said sheet feed means from the sheet stored in said sheet storing means.

7. A recording apparatus which performs a recording operation on a sheet using a recording head comprising:

a head mounting unit for mounting a recording head;

a sheet feed cassette for storing the sheet;

a sheet feed roller for feeding the sheet;

a manual sheet feed unit disposed above said sheet feed cassette;

a cover member for covering an upper surface of said sheet feed cassette; and a guide member, disposed in said manual sheet feed unit, for guiding the manually fed sheet to said sheet feed roller while underpropping the sheet, wherein said guide member is positionally fixed to said cover member, said guide member having an aperture which allows said sheet feed roller to come into contact with the sheet stored in said sheet feed cassette.

8. An apparatus according to claim 7, wherein said guide member is formed by a flexible member.

9. An apparatus according to claim 8, wherein a friction member is disposed around said aperture.

10. An apparatus according to claim 8, wherein said aperture has a height of a size so as to prevent the sheet guided by said guide member and manually fed from coming into contact with the sheet stored in said sheet feed cassette.

11. An apparatus according to claim 7, wherein said guide member has the rigidity capable of being bent when a shaft of said sheet feed roller comes into contact with said guide member.

12. An apparatus according to claim 7, further comprising a lever member for separating said sheet feed roller from the sheet stored in said sheet feed cassette.

13. An apparatus according to claim 7, wherein said recording head is an ink-jet recording head capable of discharging the ink.

14. An apparatus according to claim 13, wherein said ink-jet recording head has an electrothermal transducer for generating thermal energy utilized in discharging the ink.

* * * * *

UNITED STATES PATENT AND TRADEMARK OFFICE

CERTIFICATE OF CORRECTION

PATENT NO. : 6,659,444 B2
DATED : December 9, 2003
INVENTOR(S) : Makoto Kawarama It is certified that error appears in the above-identified patent and that said Letters Patent is hereby corrected as shown below:

Column 6,
Line 30, "into contact" (2nd occurrence) should be deleted.

Signed and Sealed this

Fifteenth Day of June, 2004

JON W. DUDAS
*Acting Director of the United States Patent and Trademark Office*